US007950512B2

(12) United States Patent
Folk et al.

(10) Patent No.: US 7,950,512 B2
(45) Date of Patent: May 31, 2011

(54) TRANSPORTATION WITHDRAWAL AND INVENTORY VERIFICATION OF CASH HANDLING DEVICE

(75) Inventors: Amy Baker Folk, Charlotte, NC (US); Daniel Christopher Bohen, Charlotte, NC (US)

(73) Assignee: Bank of America Corporation, Charlotte, NC (US)

( * ) Notice: Subject to any disclaimer, the term of this patent is extended or adjusted under 35 U.S.C. 154(b) by 193 days.

(21) Appl. No.: 12/241,196

(22) Filed: Sep. 30, 2008

(65) Prior Publication Data

US 2010/0025183 A1 Feb. 4, 2010

Related U.S. Application Data

(63) Continuation-in-part of application No. 12/183,737, filed on Jul. 31, 2008.

(51) Int. Cl.
*G07C 3/00* (2006.01)

(52) U.S. Cl. ..... 194/200

(58) Field of Classification Search ..... 194/200
See application file for complete search history.

(56) References Cited

U.S. PATENT DOCUMENTS

| | | | | |
|---|---|---|---|---|
| 5,864,826 | A * | 1/1999 | Awatsu et al. | 705/35 |
| 6,983,836 | B2 | 1/2006 | Adams et al. | |
| 7,000,778 | B2 | 2/2006 | Omori et al. | |
| 7,269,279 | B2 | 9/2007 | Chiles | |
| 7,347,358 | B2 | 3/2008 | Ireland et al. | |
| 7,548,885 | B2 * | 6/2009 | Dutta et al. | 705/43 |
| 2002/0092905 | A1 | 7/2002 | Katou et al. | |
| 2004/0231956 | A1 | 11/2004 | Adams et al. | |
| 2005/0173515 | A1 | 8/2005 | Sawa | |
| 2009/0166269 | A1 * | 7/2009 | Tanaka et al. | 209/534 |
| 2009/0320106 | A1 | 12/2009 | Jones et al. | |
| 2010/0065623 | A1 | 3/2010 | Sauter | |

FOREIGN PATENT DOCUMENTS

| | | |
|---|---|---|
| DE | 10 2006 040 780 | 3/2008 |
| WO | 2004081779 | 9/2004 |

OTHER PUBLICATIONS

PCT/US2009/058601, International Search Report and Written Opinion, dated Jan. 8, 2010.

* cited by examiner

*Primary Examiner* — Jeffrey A Shapiro
*Assistant Examiner* — Mark J Beauchaine
(74) *Attorney, Agent, or Firm* — Banner & Witcoff, Ltd.; Michael Springs

(57) ABSTRACT

A system and method for automatically conducting an inventory verification of a cash recycler are disclosed. Upon receiving an indication of a malfunction or other service issue, the cash recycler will automatically conduct an inventory verification of the cash storage portion of the cash recycler upon completion of the repair of the malfunction or service issue. In some arrangements, the automatic inventory verification will occur at regularly scheduled intervals. In still other arrangements, an upcoming transport of funds will initiate a transfer of funds from a storage region to a transport region. The cash recycler will automatically rebalance funds in the storage region upon completion of the transfer.

20 Claims, 12 Drawing Sheets

TRANSPORTATION WITHDRAWAL AND INVENTORY VERIFICATION OF CASH HANDLING DEVICE

CROSS-REFERENCE TO RELATED APPLICATIONS

This application is a continuation-in-part of U.S. application Ser. No. 12/183,737, entitled "Transportation Withdrawal and Rebalance of Cash Handling Device," filed on Jul. 31, 2008, and which is incorporated herein by reference in its entirety.

FIELD

Aspects of the present disclosure relate to a cash handling device. More specifically, aspects of the invention relate to rebalancing funds remaining in a cash handling device when performing a withdrawal or a deposit.

BACKGROUND

It is generally desirable to maintain at least a minimum amount of cash in a cash handling device in order to ensure a sufficient amount of cash is available on-hand for (customer) withdrawal. On the other hand, it is generally desirable to ensure that the amount of cash within a cash handling device does not exceed a maximum level because the cash handling device either is physically incapable of holding an amount of cash in excess of the maximum level, or exceeding the maximum level imposes an increased security risk (e.g., the cash handling device increasingly becomes an inviting target of a robber/thief).

Conventional techniques for performing inventory reduction on a cash handling device include removing cash from the cash handling device, i.e., via an output slot, counting the currency and replacing the currency in the cash handling device, for instance, into an input slot or directing into a recycling unit such as a recycling unit. These techniques are time consuming, labor intensive and may be prone to errors, theft, etc.

BRIEF SUMMARY

The following presents a simplified summary in order to provide a basic understanding of some aspects of the invention. The summary is not an extensive overview of the invention. It is neither intended to identify key or critical elements of the invention nor to delineate the scope of the invention. The following summary merely presents some concepts of the invention in a simplified form as a prelude to the description below.

Aspects described herein are directed to automatically rebalancing a cash recycler in response to a triggering event. In some arrangements, repair of a service issue, such as a jam in the cash recycler or other malfunction may initiate automatic rebalancing or inventory verification of the cash recycler. In other arrangements, completion of scheduled maintenance may automatically initiate inventory verification of the cash recycler. In another arrangement, automatic inventory verification may be initiated when a client, such as personnel in a retail store, etc., toggles between an off-line mode, i.e., a mode used for training purposes, to an on-line mode, i.e., for typical operation. In conventional arrangements, all funds would be extracted before changing modes then the device would be reloaded. In this arrangement, an automatic inventory verification of each recycling unit may be performed to ensure a proper count. Completion of the inventory verification may include transmission of data to a financial institution for reconcilement with the client account.

In other examples, a cash recycler may receive an indication that a transport of funds is upcoming. In response, funds may be transferred from a storage area to a transport area. Upon completion of the transfer of funds, the cash recycler may automatically conduct an inventory verification of the funds in the storage area. In one arrangement, the funds may be dropped off to the cash recycler and the automatic inventory verification may be conducted with or without the carrier present. For instance, funds may be dropped off and the carrier may continue to another drop off while the inventory verification process is conducted.

In still other arrangements, the cash recycler may automatically conduct an inventory verification based on a predetermined schedule. For instance, the cash recycler may automatically run an inventory verification audit at prearranged times, such as daily, weekly, monthly, etc.

BRIEF DESCRIPTION OF THE DRAWINGS

The present disclosure is illustrated by way of example and not limited in the accompanying figures in which like reference numerals indicate similar elements.

The reader is advised that the attached drawings are not necessarily drawn to scale.

DETAILED DESCRIPTION

In accordance with various aspects of the disclosure, systems and methods are illustrated for providing currency handling services. A cash handling device such as a cash recycler may provide for fund rebalance/reallocation on a remaining portion of funds following a withdrawal using the currency handling apparatus, system, and method described below in various aspects of the invention. For illustrative purposes the financial instrument discussed throughout the below description is cash. However, as those skilled in the art will realize, the described aspects of the invention are not limited to just cash (paper money and coins), but may also include other forms of liquid assets such as checks, bank notes, and money orders.

Figure 1:
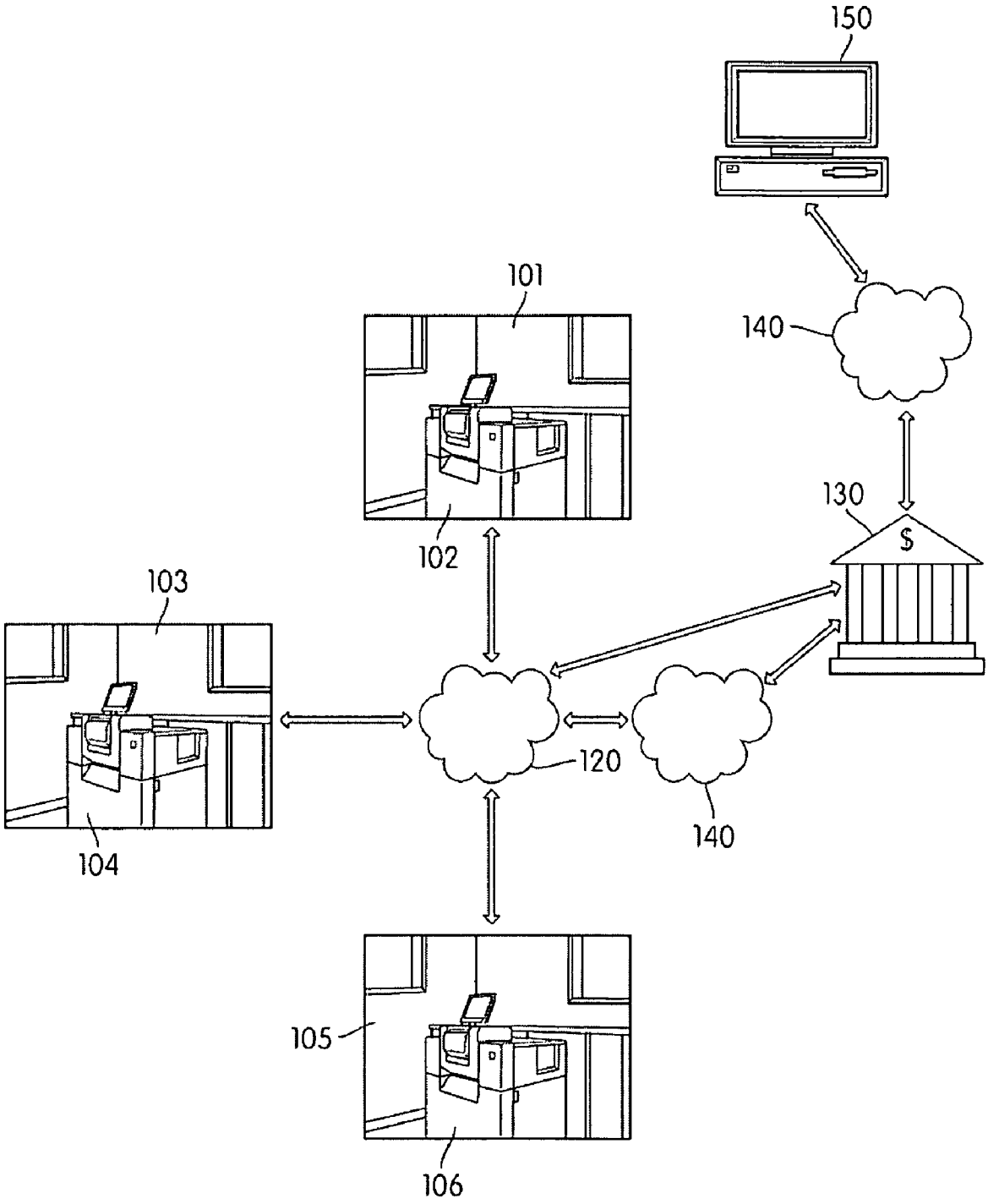
FIG. 1 illustrates an example of a suitable operating environment in which various aspects of the disclosure may be implemented.

FIG. 1 illustrates an example of a suitable operating environment in which various aspects of the disclosure may be implemented. Devices 102, 104, 106 may include currency recyclers and/or other cash handling devices and may be located at various sites such as locations 101, 103, and 105. The locations may represent different stores of a business enterprise. For example, locations 101, 103, and 105 may represent three different grocery stores located in different geographical areas belonging to a grocery store chain. Those skilled in the art will realize that additional cash handling devices may be located in the same store or in other stores belonging to the grocery store chain. In addition, those skilled in the art will realize that a grocery store chain is only one illustrative example of the types of locations or businesses that cash handling devices such as recyclers may be located. For example, cash recyclers may also be located in gas stations, post offices, department stores, and other places where cash and other financial instruments are deposited or withdrawn.

FIG. 1 further illustrates that cash handling devices 102, 104, and 106 may be connected to a communications network such as communications network 120. Communications network 120 may represent: 1) a local area network (LAN); 2) a simple point-to-point network (such as direct modem-to-modem connection); and/or 3) a wide area network (WAN), including the Internet and other commercial based network services.

Cash handling devices 102, 104, and 106 may communicate with one another or with a financial institution such as bank 130 via communication network 120 in various manners. For example, communications between cash handling devices 102, 104, 106 and bank 130 may use protocols and networks such as TCP/IP, Ethernet, FTP, HTTP, BLUETOOTH, Wi-Fi, ultra wide band (UWB), low power radio frequency (LPRF), radio frequency identification (RFID), infrared communication, IrDA, third-generation (3G) cellular data communications, Global System for Mobile communications (GSM), or other wireless communication networks or the like. Communications network 120 may be directly connected to a financial institution such as bank 130. In another embodiment, communications network 120 may be connected to a second network or series of networks 140 such as the STAR network before being connected to bank 130. According to one or more arrangements, bank 130 may utilize an infrastructure which includes a server 150 having components such as a memory, a processor, a display, and a communication interface.

Figure 2A:
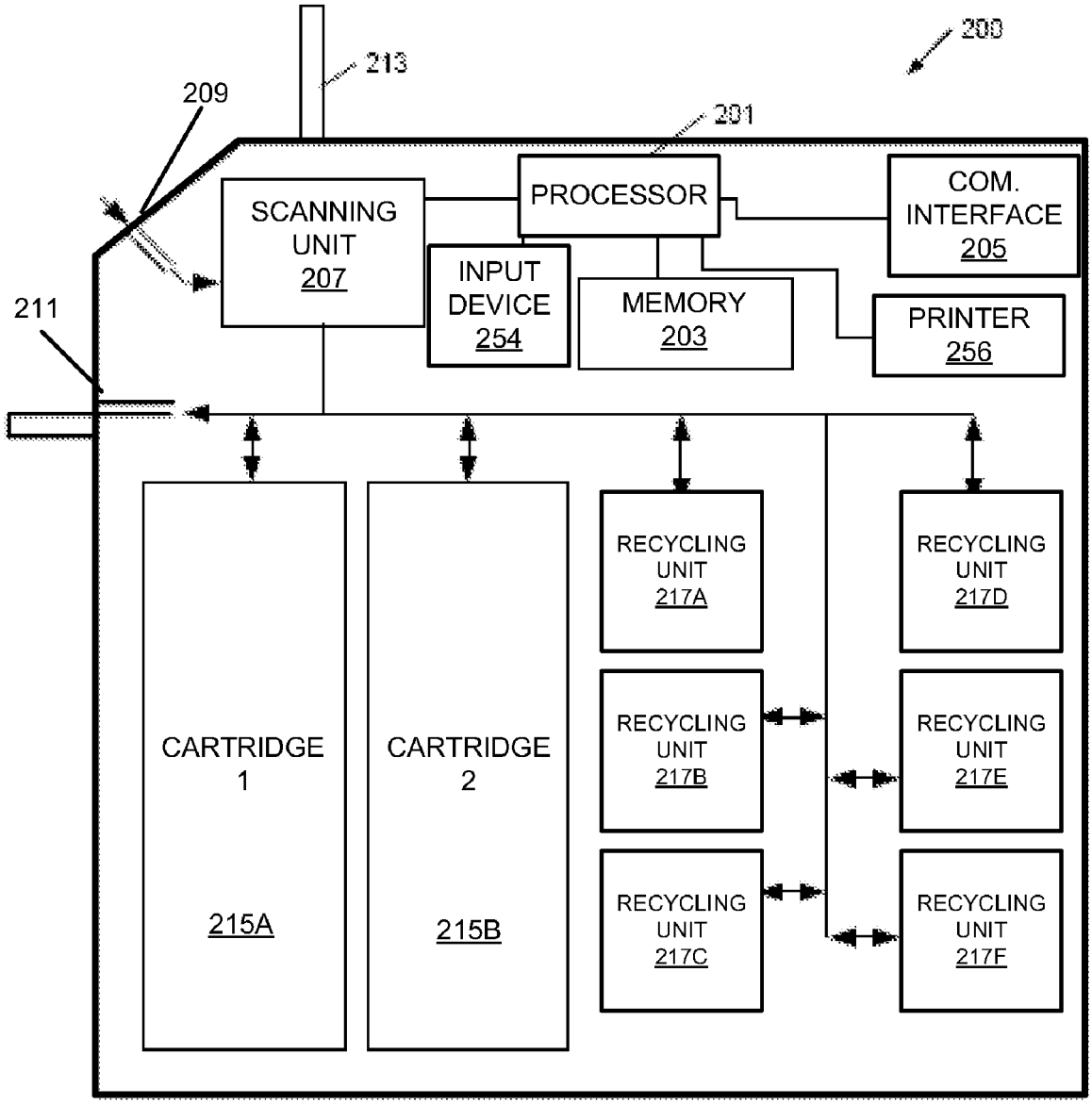
FIG. 2A illustrates a simplified diagram of a cash recycler in which various aspects of the disclosure may be implemented.

FIG. 2 illustrates a simplified diagram of a cash recycler that may be used in accordance with the operating environment of FIG. 1. Cash recycler 200 may include processor 201, memory 203, communication interface 205, scanning unit 207, display 213 and various cartridges 215 and recycling units 217. Processor 201 may be generally configured to execute computer-readable instructions stored in memory 203 such that, for example, cash recycler 200 may send and receive information to and from a bank (e.g., bank 130 of FIG. 1) using communication interface 205 and via a network (e.g., networks 120 and/or 140 of FIG. 1). Memory 203 may be configured to store a variety of information including the aforementioned computer-readable instructions, funds balance data, reconciliation data, user account information and the like. Additionally, memory 203 may include non-volatile and/or volatile memory. One or more databases may be stored in the memories 108, 112, and 116.

Cash recycler 200 may further provide display 213 to present data and/or messages to a user. For example, display 213 may be configured to display a recycler balance, a transaction interface, a current deposit count, security options, transportation options and the like. One or more input devices 254 such as a keypad, keyboard, mouse, touchscreen, fingerprint scanner, retinal scanner, proximity card reader, RFID scanner and/or writer, magnetic card reader, barcode reader, and/or combinations thereof, or any other type of input device or reader capable of inputting, reading, or scanning indicia or information, may also be included in or connected to recycler 200. One or printers 256 may also be included in or connected to recycler 200 for printing receipts and notifications as well.

In cash recycler 200, recycling units 217, such as stackers or rolled storage modules (RSMs) and cartridges 215 are configured to store currency. Currency may be inserted through input slot 209 and withdrawn through withdrawal slot 211. Recycling units 217 may be used to store and organize currency based on denomination. For example, all $5 bills may be stored in recycling unit 2 (i.e., recycling unit 217B) while all $20 bills may be stored in recycling unit 3 (i.e., recycling unit 217C). Cartridges 215A and 215B, on the other hand, may be used to store overflow currency and/or currency for transport or replenishment of the machine. For instance, cartridge 215A may be used as an overflow cartridge. That is, currency may be stored in cartridge 215A and, additionally or alternatively, overflow from one or more recycling units 217 may be transferred to the cartridge 215A and stored therein. In one example, a recycling unit 217 may have a predetermined maximum threshold based on the maximum number of bills to be maintained in the recycling unit 217. Should that threshold be breached, the additional overflow currency may be transferred to cartridge 215A for storage.

In other arrangements, a routine may be run at a predetermined time, i.e., at night or after close of the business, where each recycling unit is emptied to a certain target threshold. The target threshold may be a predetermined threshold that indicates an optimum number of bills in the recycling unit 217. The target threshold may be adjusted and is intended to maximize the time between required replenishment/removal of bills. As the emptying routine is run, any bills in excess of the target threshold may be transferred to cartridge 215A for storage.

In some arrangements, cartridge 215B may be used for inventory verification purposes. For instance, cartridge 215B may be empty in order to facilitate the inventory verification process, as will be described more fully below. Additionally or alternatively, cartridge 215B may be used to replenish the recycling units 215. For instance, cartridge 215B may be full or partially full of mixed denominations of currency. As each recycling unit 217 is drawn below its target threshold, currency from the cartridge 215B may be transferred to the recycling unit 215 below its threshold to replenish the recycling unit 215. Upon completion of the replenishment, a notification may be sent to the transportation carrier, financial institution, client, etc. indicating that the replenishment has occurred. The notification may include any discrepancies between the expected count of bills and the actual count of bills. The notification may be sent via text messaging, email, or other form of communication.

Figure 2B:
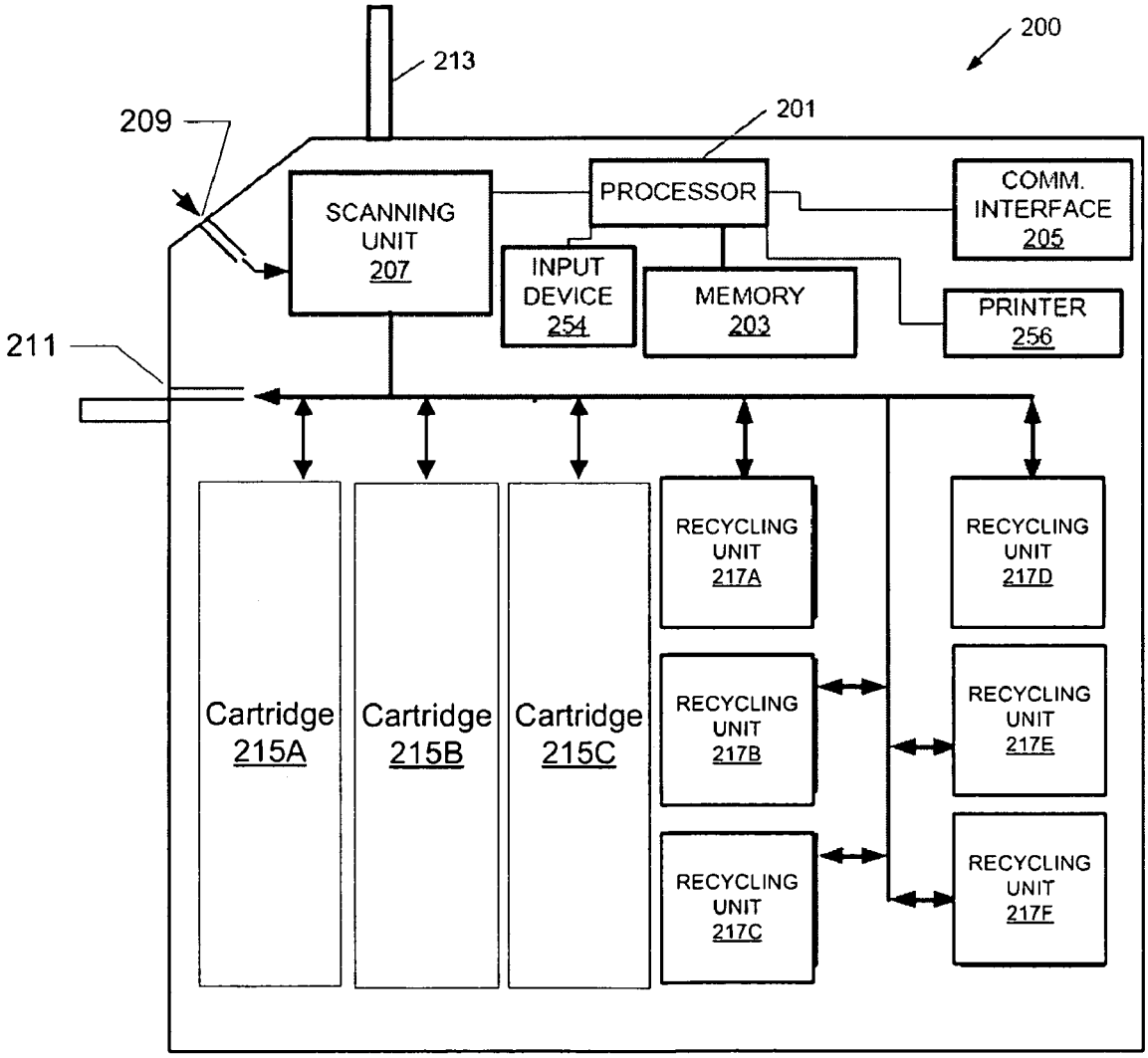
FIG. 2B illustrates a simplified diagram of another cash recycler in which various aspects of the disclosure may be implemented.

FIG. 2B illustrates an alternate arrangement wherein three cartridges are used. Cartridges 215A and 215B may perform functions similar to those described above with respect to FIG. 2. In addition, cartridge 215C may be used as a designated replenishment cartridge. That is, cartridge 215B may be empty for use in inventory verification processes while cartridge 215C may contain a stock of mixed denomination bills to be transferred to one or more recycling units 217 as the recycling units 217 are drawn below the target level. In some arrangements, a routine may be run, i.e., nightly, after business hours, etc., in which currency from cartridge 215C is transferred to each recycling unit 217 below its target threshold to fill the recycling unit 217 to its target threshold.

In arrangements including a designated cartridge for verification, i.e., cartridge 215B that remains empty until used to contain the currency removed from the recycling unit during inventory verification, the cartridge 215B may have a capacity greater than that of the highest capacity recycling unit. This arrangement ensures that the cartridge 215B will accommodate any expansion or increase in volume due to crumpling of the bills, etc. when the bills are placed in the cartridge 215B during inventory verification.

In still other arrangements, one of cartridges 215 may be designated as a transport cartridge that stores currency to be withdrawn from the machine and transported to the bank. Alternatively or additionally, one or more of cartridges 215 may be used as an unfit bill store for currency determined to be defective to a degree that it should be taken out of circulation. Cartridges 215 and recycling units 217 may further be removable for easier access or transport. As described above, each of cartridges 215A, 215B and 215C have various functions. However, the functions are not particular to any one cartridge. Instead, any of the cartridges 215A-215C may be configured to perform any of the cartridge functions described above.

Scanning unit 207 may be configured to scan each bill or currency that is inserted into recycler 200. Scanning unit 207 may be configured to detect defects, counterfeits, denomination, type of currency (e.g., which country the currency originates from) and the like. Scanning unit 207 may further be configured to refuse money (either through input slot 209 or withdrawal slot 211) if it cannot be properly recognized or if the currency is deemed to be counterfeit. Scanning unit 207 may send such data to processor 201 which may, in turn, save the data in memory 203.

Further, recycler 200 may include one or more mechanical or electromechanical systems (not shown) for automatically transferring currency between recycling units 217, cartridges 215, input slot 209 and withdrawal slot 211 in recycler 200. For example, currency may automatically be withdrawn from recycling units 217 and directed into cartridge 215A for storage using a series of motorized rollers. In another example, currency stored in cartridge 215A may be withdrawn and organized and stored into recycling units 217 according to denomination. Using such systems to facilitate the automated movement of currency between storage components and other portions of recycler 200 may provide efficiency and security by alleviating some of the need to manually handle currency stored within recycler 200.

Figure 3:
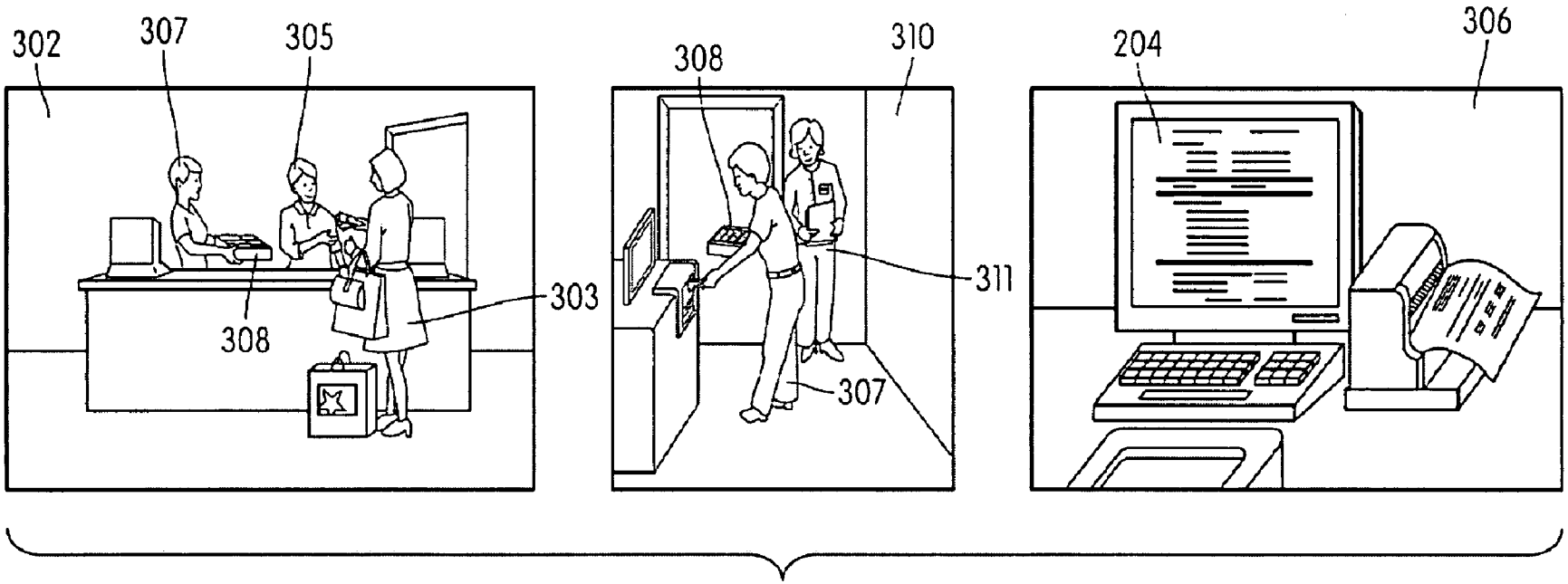
FIG. 3 illustrates various features of a cash recycler in which various aspects of the disclosure may be implemented.

FIG. 3 illustrates various features of cash recycler, such as cash recycler 200 of FIG. 2, used in various aspects of the invention. The images in FIG. 3 depict use of a single cash recycler 200 in a retail environment. The retail owner may have a cash recycler 200 located in each of their stores. In an aspect of the invention, summary information for the retail owner's stores may be available via an interface to the financial institution. In another embodiment, access to summary information may be available directly from each of the cash recyclers 200.

In FIG. 3, image 302 depicts customer 303 paying cash to a retail employee such as store cashier 305 for a purchase. Another store cashier 307 at a recently closed cash register may be carrying a cash drawer or till 308 to a back office for reconciliation. In image 310, store cashier 307 may load currency from cash register till 308 into cash recycler 200. In addition, store cashier 307 may also deposit other paper forms of payment received from customer such as checks. An office manager 311 may be supervising cashier 307 during the loading of cash register till 308 into cash recycler 200. Moreover, upon the start of a shift a cashier may fill his/her cash register till with a designated amount of currency dispensed from cash recycler 200.

In image 306 of FIG. 3, a display screen (e.g., display 213 of cash recycler 200 of FIG. 2) may show the total amount entered into cash recycler 200 from till 308. The display screen 213 may breakout the amount entered into cash recycler 200 by denomination and by each cashier. The total amount deposited and withdrawn from cash recycler 200 may be shown on display screen 213.

Figure 4:
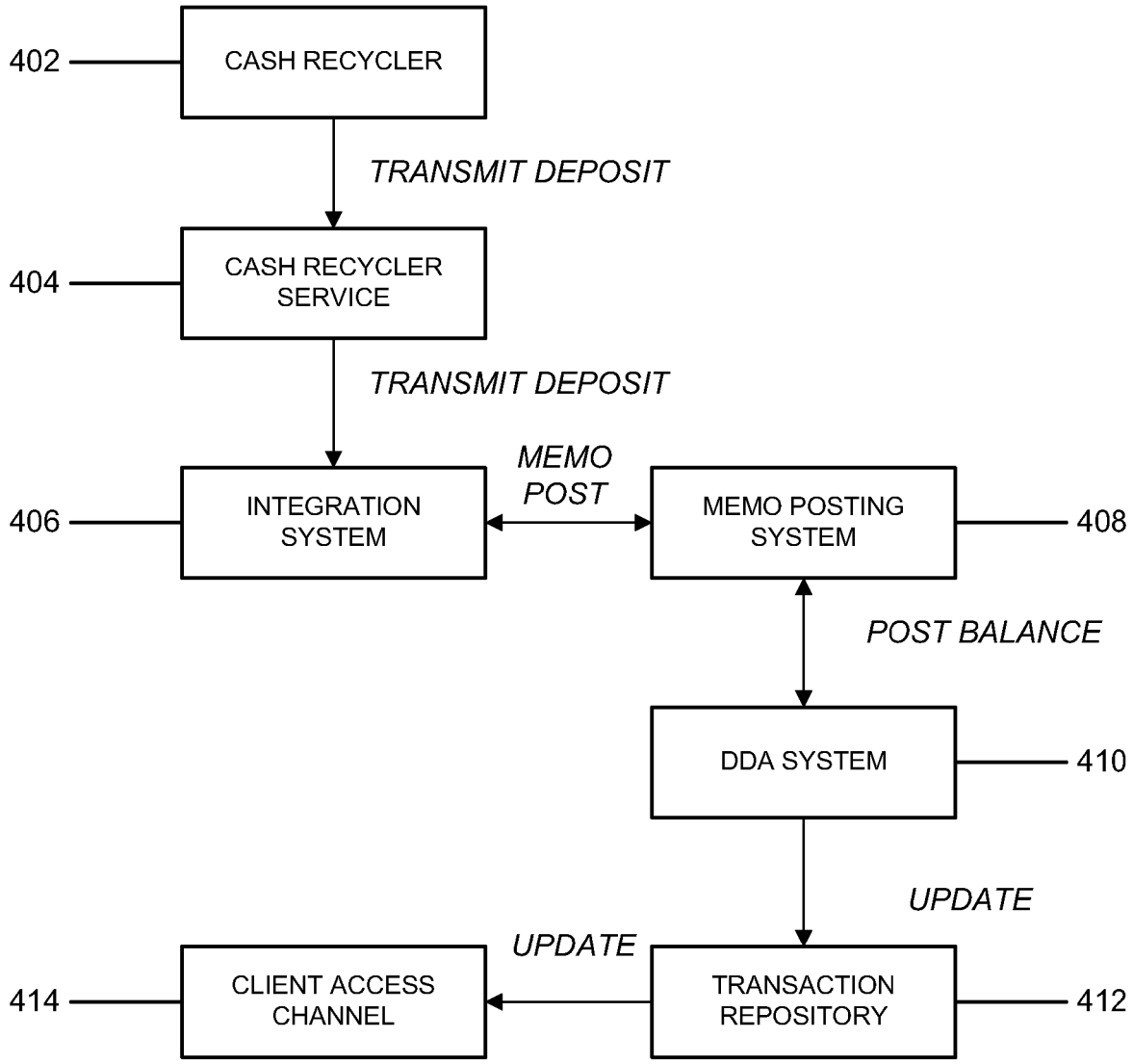
FIG. 4 illustrates a system configuration that may be used in accordance with an aspect of the invention.

FIG. 4 illustrates a system configuration that may be used in accordance with an aspect of the invention. In FIG. 4 a cash recycler 402 may communicate information to cash recycler service 404 located at a remote location. For example, cash recycler 402 may communicate deposit and withdrawal information from an enterprise location (e.g., a retail store) to the remote cash recycler service 404. The information may be routed through various networks such as the Internet to reach the cash recycler service. The cash recycler service 404 may be located in the data center of a financial institution. The cash recycler service 404 may communicate with an integration system 406 which provides access to the financial systems and processes. The integration system 406 may communicate with a memo posting system 408 which may perform posting activity. The posting system 408 may update the appropriate DDA (direct deposit account) system 410 to reflect the balance changes in the enterprises account balances. The DDA system 410 may also update a transaction repository 412 for historical and intra-day reporting purposes. An enterprise employee may access information stored in the transaction repository 412 through a client access channel 414 via web browser. Those skilled in the art will realize that the financial institution may allow the enterprise user to access the information stored in the transaction repository via numerous alternative communication methods.

According to one aspect, cash recyclers such as cash recycler 102 (FIG. 1) and 200 (FIG. 2) and other cash handling devices may facilitate real-time recognition of funds. In particular, funds deposited at a recycler or other cash handling device at a client site may be recognized by a bank at the time the deposit is made. Recognition refers to the real credit (i.e., not provisional) of deposited funds into a client's account. In contrast to current systems, there is no delay between a deposit of funds and when the funds and transaction data are submitted to the bank for recognition. Thus, instead of having to wait until the end of the day or another prescheduled time for deposits and/or withdrawals to be recognized by the bank, each deposit is processed for recognition in real-time. Data regarding the withdrawal or deposit transaction may be transmitted through a data network to the bank for recognition and processing. Providing real-time recognition offers may advantages including the ability for a client to withdraw the same currency that was earlier deposited for use in the client's operations, all at the client site and without having to first transport the deposited funds to the bank for recognition. Currency recyclers, recycling management and recognition of funds are further described in U.S. application Ser. No. 11/614,656, entitled "Commercial Currency Handling and Servicing Management," filed on Dec. 21, 2006, the content of which is incorporated herein by reference in its entirety.

Figure 5:
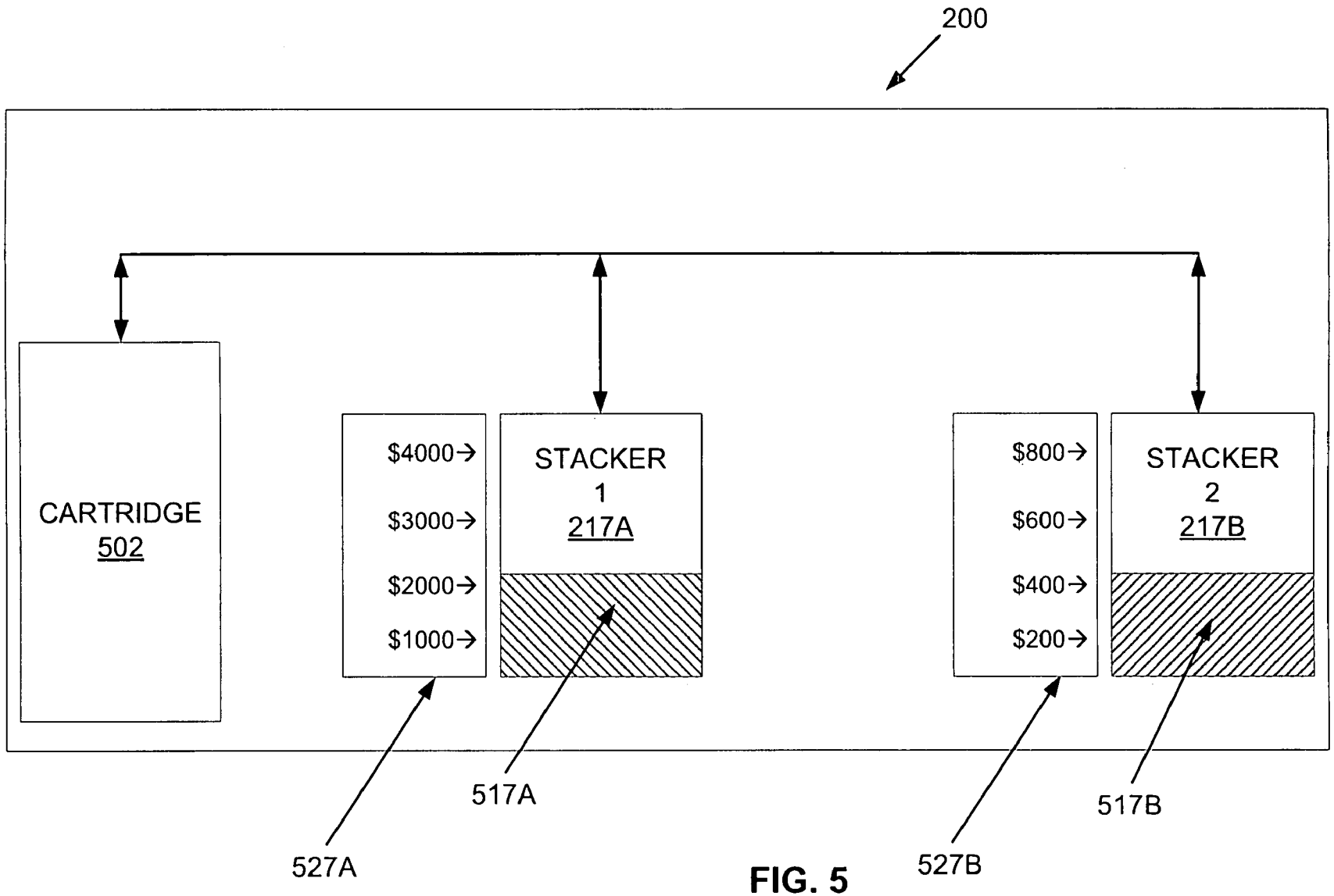
FIG. 5 illustrates a simplified diagram of a cash recycler in which various aspects of the disclosure may be implemented.

FIG. 5 illustrates a simplified diagram of cash recycler 200. In FIG. 5, the recycler is shown as including recycling units 217A-217B of FIG. 2 and cartridge 502. In some embodiments, cartridge 502 is one of cartridges 215A-215B of FIG. 2. In other embodiments, cartridge 502 is in addition to cartridges 215A-215B. In FIG. 5, recycling units 217A-217B are shown as being comprised of reserve regions 517A-517B, respectively. The heights or depths of reserve regions 517A-517B represent a minimum amount of cash intended to be maintained within each of recycling units 217A-217B after cash recycler 200 has been serviced.

In some embodiments, the heights or depths associated with reserve regions 517A-517B may (simply) be a conceptual representation, wherein a person servicing cash recycler 200 estimates an appropriate amount of cash to be left behind in each of recycling units 217A-217B. In other embodiments, recycling units 217A-217B may be fabricated with grooves or slots, and an operator may insert a physical plate at a particular height or level of recycling units 217A-217B to assist a person servicing cash recycler 200 in determining how much cash to leave behind in recycling units 217A-217B. These techniques may be used to support a manual determination and extraction of cash. Alternatively, or additionally, a control module (which may include a processor such as processor 201 of FIG. 2) may be implemented in cash recycler 200 and may be used to define an appropriate amount of cash to be left in cash recycler 200 after servicing, thereby assisting service personnel in determining an amount of cash to be removed/withdrawn from cash recycler 200. The appropriate amount of cash may be either a logical threshold or a physical threshold.

Alternatively, a measurement scale such as 527A and 527B may be used with respect to recycling units 217A and 217B, respectively, to provide an approximate correlation between the height of a stack of cash within each of recycling units 217A and 217B and the amount of cash in the recycling unit 217A, 217B. The resolutions provided with respect to measurement scales 527A and 527B are merely illustrative, and it is understood that finer or coarser resolution schemes may be used. For example, with respect to measurement scale 527A, a gradation scheme in increments of five hundred dollars ($500) may be used instead of one thousand dollars ($1000) as shown. Furthermore, tolerances may be included (not shown in FIG. 5) to provide an indication of uncertainty in the approximation. Measurement scales 527 may aid service personnel by correlating an amount of cash to be left in cash recycler 200 after servicing with the cash amount extracted as determined by the control module described above.

As described above, the height or level of cash associated with reserve regions 517A-517B may be adjusted on a manual basis (e.g., via the insertion of a physical plate). In some embodiments, cash recycler 200 (or more specifically, the control module described above) may play a role in determining an appropriate height or level. For example, cash recycler 200 may maintain an electronic calendar or the like and provide for different heights or levels based on the day of the week (e.g., extra cash may be maintained in cash recycler 200 on Saturdays and Sundays in comparison to other days of the week, or on select holidays, due to an expectation that increased amounts of withdrawals (by customers) will be demanded on those select days). In some embodiments, cash recycler 200 may include additional hardware, software, firmware or the like to compute recent trends with respect to deposits and withdrawals and adjust the height or level associated with reserve regions 517A-517B accordingly. Alternatively, cash recycler 200 may receive one or more messages, commands, directives or the like from a computing device (e.g., a mobile terminal, a server, etc.) to adjust a height or level associated with reserve regions 517A-517B.

In still other arrangements, the amount of currency in a cartridge or recycling unit may be maintained using a logical count of bills in the unit. For instance, a bill validation unit may be used to maintain a logical count of all bills in each recycling unit and/or cartridge. In order to perform inventory verification, the logical count may be compared to the physical count to verify inventory within the unit. As compared with use of measurement scales, the level of bills would be replaced with a logical count of bills in the unit as maintained by the software controlling and maintaining the count.

After servicing cash recycler 200 is complete, as indicated by closing/re-sealing a door or panel on cash recycler 200, etc., it may be desirable to perform an inventory verification process, i.e., rebalance/reallocate, the remaining funds in cash recycler 200 to provide for a complete accounting. For example, with respect to FIG. 5, service personnel may take cash from recycling units 217A-217B, leaving behind an amount of cash equal to the heights/levels indicated by reserve regions 517A-517B, respectively or as indicated by the logical count. Service personnel may also deposit funds (into cartridge 502 or stackers 217A-217B, for example) for purposes of replenishing recycling units 217, particularly when an amount of cash in a recycling unit 217 falls below the height of its associated reserve region 517 or below a predetermined logical count. In some arrangements, a complete cartridge 502 or stacker 217A-217B may be exchanged for the cartridge or stacker already in the recycling unit.

In some embodiments, recycling units 217 are configured with scales or the like that measure weight and compute an amount of cash left behind in reserve regions 517A-517B based on the measured weight (e.g., by dividing each measured weight by the weight per bill).

In alternative embodiments, cash within reserve regions 517A-517B may be counted by displacing all of the remaining cash in recycler 200 from recycling units 217 to a cartridge (e.g., cartridge 502), and then returning the cash from the cartridge to the appropriate recycling units 217. The actual counting operation may be performed when the cash is (initially) moved from recycling units 217 to cartridge 502. In the arrangement described, cartridge 502 may be empty for the purpose of facilitating this inventory verification, while a second cartridge (not shown) may be used to store currency, similar to the arrangement described above with respect to FIG. 2. Alternatively, or additionally, the counting operation may be performed when the cash is returned from cartridge 502 to recycling units 217. In some embodiments it may be desirable to count both when moving cash from recycling units 217 to cartridge 502 and when moving the cash back from cartridge 502 to recycling units 217 in order to improve reliability or accuracy. For example, while servicing cash recycler 200, service personnel may place a denomination of cash intended for a first recycling unit (e.g., recycling unit 217A) in a second recycling unit (e.g., recycling unit 217B) by accident. Accordingly, counting the displaced cash moved from the recycling units to the cartridge may assist in reconciling this discrepancy. More generally, counting the amount of cash displaced out of or into recycling units 217 may be used to determine an amount of funds withdrawn and deposited while servicing the cash recycler 200 as more fully described below. Alternatively or additionally, service personnel may extract/withdraw cash from cash recycler 200 and then re-deposit the extracted cash into cash recycler 200 (e.g., instead of moving currency only within the recycler 200). In some embodiments, the re-deposit operation takes place using an input slot (e.g., input slot 209 of FIG. 2). In other embodiments, cash recycler 200 is configured with one or more additional input slots to support such re-deposit operations.

In some embodiments, a scanner (e.g., scanning unit 207 of FIG. 2) is used to facilitate the counting operation. For example, if service personnel deposited cash in cartridge 502 for purposes of refilling/replenishing reserve regions 517A-517B, a scanner may be used to distinguish the type of cash or bill that has been provided (to determine whether a particular deposited cash bill should be routed to recycling unit 217A versus 217B, for example). In alternate arrangements, a separate cartridge may replace cartridge 502 with the appropriate currency in the cartridge for replenishing recycling units 517A-517B.

Figure 6A:
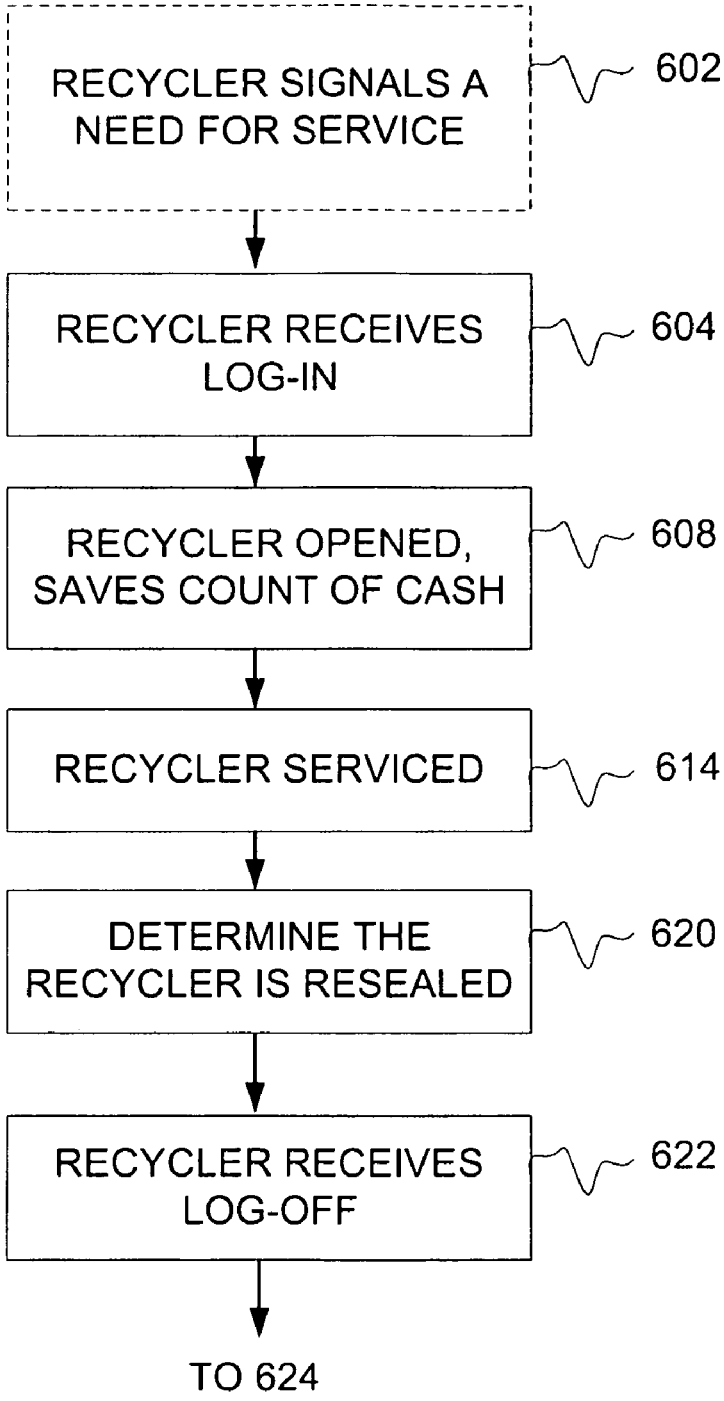
FIG. 6 illustrates a method suitable for implementing one or more aspects of the invention.
Figure 6B:
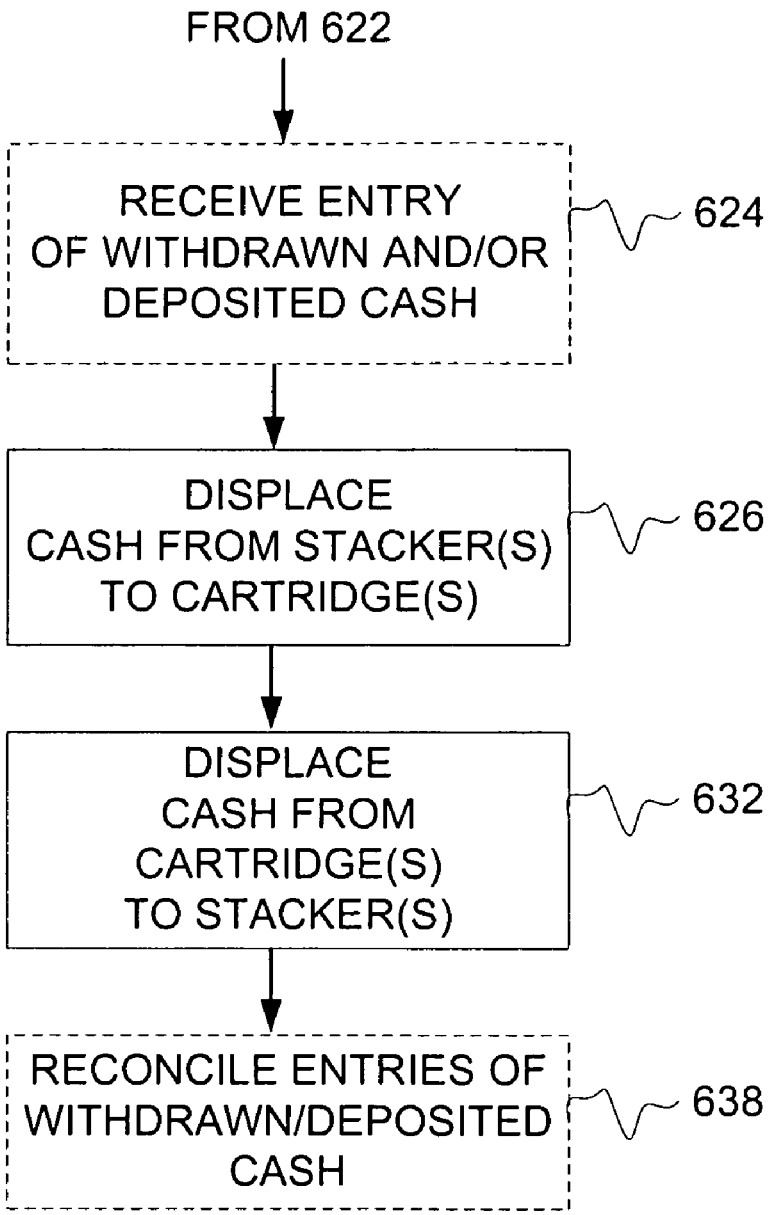

FIG. 6 illustrates a method suitable for carrying out one or more aspects of the instant disclosure. In step 602, a cash recycler (e.g., cash recycler 200 of FIG. 2 or FIG. 5) may generate a signal indicating a need for service. As described above, the signal may result from cash within recycling units (e.g., recycling units 217) falling below a threshold level established by reserve regions (e.g., reserve regions 517A or 517B associated with FIG. 5) or a projection of a level of currency dropping below the threshold level. Alternatively, or additionally, the signal may be the result of a net excess of cash (beyond a threshold) having been deposited within the cash recycler (or one or more of recycling units 217) since the last time the cash recycler was serviced or the maximum threshold being passed on one or more cartridge. In some embodiments, step 602 is optional (as indicated by the broken/dashed lines associated with the box corresponding to step 602 in FIG. 6). For example, service personnel may routinely service a cash recycler before the cash recycler has an opportunity to approach capacity or threshold (e.g., reserve region 517) limits, thereby precluding the need to provide for such signaling in those embodiments. For instance, minimum and maximum levels may be predetermined at which a service signal may be generated to indicate the need for service. In some arrangements, meeting the minimum or maximum level will automatically initiate a transfer of currency from the recycling unit to the overflow cartridge, in the case of a maximum being reached, or a transfer of currency from a replenishment cartridge to the recycling unit, in the case of a minimum being reached. The transfer of currency may occur upon reaching the minimum or maximum or it may be delayed until a more convenient time, such as at night, after business hours, etc.

Service personnel may gain access to the cash recycler via, such as via a KABA-MAS lock as described in U.S. patent application Ser. No. 12/212,442, filed on Sep. 17, 2008 and entitled "Lock Interaction with Software to Facilitate Access to Cash Handling Device Functionality" and incorporated herein by reference in its entirety. In step 604, service personnel may provide log-in information to the cash recycler. For example, in accordance with step 604, service personnel may provide any preliminary information regarding the service personnel's identity (e.g., using a name, Personal Identification Number (PIN), finger-print analysis, retinal scan, RFID tag scan or the like) and/or the servicing operation to be performed. Responsive to the entry of such information, the cash recycler (or another computing entity) may verify and grant access to service personnel to perform an authorized servicing operation. If the entered information is incorrect, a warning message or the like may be displayed advising service personnel to reenter the information. If a number of attempts to log-in are unsuccessful, the cash recycler may prohibit further attempts to log-in and enter a lock-down mode; repeated failures may be construed in some embodiments as an unauthorized attempt at obtaining access to the cash recycler.

In step 608, service personnel opens the cash recycler. Opening the cash recycler may include turning a key, entering a password or the like to provide for authorization/security. As part of step 608 (or prior to step 608, i.e., as a part of step 604) the cash recycler may save/status in memory (e.g., memory 203 of FIG. 2) the amount of cash in the cash recycler for purposes of reconciliation and generating confirmation(s) as will be described more fully below.

In step 614 service personnel services the cash recycler. Step 614 may include service personnel removing cash from the cash recycler (e.g., removing cash from one or more stackers 217) as a (manual) withdrawal. In other arrangements, currency may be removed from one or more cartridge, such as an overflow cartridge, or, in some arrangements, an entire cartridge may be exchanged for a cartridge in the cash recycler. Step 614 may also include service personnel (manually) depositing cash into the cash recycler (or more specifically, depositing cash into a cartridge such as cartridge 502 of FIG. 5, depositing cash into one or more recycling units 217, such as a stacker, or depositing cash into a deposit slot). In alternative embodiments, rather than having service personnel manually withdraw or deposit cash, cash recycler 200 is configured to automatically extract (as a withdrawal) or accept (as a deposit) cash to/from service personnel. Thus, cash recycler 200 may, for example, automatically determine and dispense the amount of funds to be given to the transport carrier or other service personnel without the service personnel having to manually extract the funds from within recycler 200. Withdrawal slot 211 and input slot 209 of FIG. 2 may be used for these operations, or cash recycler 200 may be configured with additional slots to support these operations. In these alternative embodiments, it might not be necessary to physically open the cash recycler as described in step 608, thereby enhancing security and minimizing an amount of cash that is potentially exposed.

In step 620 service personnel completes servicing the cash recycler by closing/resealing the cash recycler. The step of resealing the cash recycler may include turning a key, entering a password, or providing some other type of verification that the cash recycler is completely shut and secured.

In step 622, service personnel may log-off of the cash recycler to serve as an indication (in addition to closing/resealing the cash recycler in step 620) that the service personnel deems the servicing operation to have been completed. A log-off command may require service personnel to take an affirmative action (e.g., turning a key to place a lock associated with the cash recycler in a locked state, entering a password, PIN number, or the like). Alternatively, a log-off command may be inferred based on a lack of activity (e.g., a timeout) or a (previous) sequence of steps having been successfully completed. Inferring a log-off command may help to ensure that service personnel do not remain liable for funds because the service personnel forgot to affirmatively engage in a log-off, as well as providing increased security with respect to cash remaining in the cash recycler after servicing.

In (optional) step 624, the cash recycler may receive a numerical data entry corresponding to what service personnel asserts is an amount that was withdrawn from or deposited into the cash recycler during servicing in accordance with step 614. The entry of numerical data may take place using one or more keyboards, touchscreens or other input device(s) associated with the cash recycler. Alternatively, or additionally, service personnel may use another computing device (e.g., a mobile terminal) for purposes of entering the numerical data. Service personnel may enter a total amount withdrawn and a total amount deposited, or may enter the data with respect to each cash denomination (e.g., withdrew X five dollar bills, withdrew Y ten dollar bills, deposited Z twenty dollar bills, where X, Y, and Z are integers). Step 624 is optional in the sense that the control module described above may have already determined the amount to retain within the cash recycler after servicing as well as the amount to be withdrawn, however, it is understood that step 624 may be implemented to improve reliability and to guard against a potential cash recycler failure. The data entry may be used to perform reconciliation as described below with respect to step 638.

In step 626 the cash recycler displaces cash from one or more recycling units (e.g., recycling units 217 of FIGS. 2 and 5) to one or more cartridges (e.g., cartridge 502 of FIG. 5) responsive to the cash recycler being resealed in step 620. A counting operation may be conducted as described above when displacing the cash in accordance with step 626. The cash recycler may subtract the count of cash displaced in step 626 from the count of cash saved in step 608 to determine a (net) amount of cash that service personnel removed as a withdrawal. For example, if in the process of servicing the cash recycler as described above with respect to step 614 service personnel withdrew B five dollar bills from recycling unit 217B, and deposited C five dollar bills into recycling unit 217B, the net amount withdrawn with respect to the number of five dollar bills would be B-C, where B and C are integers. Moreover, one of skill in the art would appreciate that the sign (e.g., + or −) of the result of B-C indicates whether a net amount of five dollar bills was deposited or withdrawn with respect to a given recycling unit (e.g., recycling unit 217B in this example).

In step 632, the cash recycler displaces the cash, but this time from the one or more cartridges to the one or more recycling units. A counting operation may take place to determine an amount of cash displaced from the one or more cartridges to the one or more recycling units. The cash that is placed in the one or more recycling units during step 632 may include the cash that was displaced from the one or more recycling units to the one or more cartridges in step 626 plus any additional cash that may have been deposited into the one or more cartridges by service personnel. As such, in accordance with step 632 the cash recycler may subtract the count of cash displaced in step 626 from the count of cash displaced in step 632 to determine an amount of cash that service personnel deposited into the one or more cartridges. After completing step 632, an amount of cash within the cash recycler will be rebalanced for future operations (e.g., future iterations of the method of FIG. 6).

It is understood that step 626 (and step 632) may automatically take place internal to the cash recycler, thus precluding of a need on the part of service personnel to remove cash that is intended to remain in the cash recycler after servicing. That is, cash may automatically be displaced between one or more recycling units 217, one or more cartridges, or RSMs (e.g., once service personnel have completed servicing the cash recycler as per step(s) 620 and/or 622 above). Accordingly, since human intervention might not be required, the activities associated with step 626 (and step 632) may be triggered after a specified event (e.g., a net amount of funds withdrawn or deposited from the cash recycler exceeding a threshold value) or on a regular schedule.

One or more confirmations may be generated in the form of a report, receipt, e-mail, auditory indicator, or the like. The one or more confirmations may indicate an amount of cash removed from the cash recycler by service personnel as a withdrawal (as described above with respect to step 626), an amount of cash placed into the cash recycler by service personnel as a deposit (as described above with respect to step 632), and the total amount of rebalanced funds remaining in the cash recycler after servicing. The one or more confirmations may (simply) provide the total amounts withdrawn, deposited, and rebalanced, or may optionally provide details as to an amount with respect to each recycling unit 217 or bill (e.g., the one or more confirmations may indicate the number of five dollar ($5) bills withdrawn and deposited by service personnel). As shown in (optional) step 638, a reconciliation process may take place to determine whether the (counted) amount of funds withdrawn/deposited in accordance with steps 626 and/or 632 corresponds to the numerical values entered in step 624. As part of step 638, one or more confirmations may be generated to indicate whether cash has been (successfully) reconciled. One skilled in the art would appreciate that step 638 may be used to identify discrepancies immediately, allowing corrective action to be taken within a relatively prompt time frame should there be an indication of an error.

In those embodiments where the recycler signals a need for service in accordance with step 602, the signal may be deasserted once service personnel has completed servicing the recycler, assuming that service personnel has either withdrawn or deposited an appropriate amount of cash such that the signaling condition is no longer present. As such, the deassertion of the signal may serve as (further) confirmation that the recycler has been serviced in an appropriate manner to remove the condition that was responsible for generating the asserted signal in step 602.

The method of FIG. 6 was described above in the context of a cash recycler having recycling unit(s) and cartridge(s). It is understood that a cash recycler may be configured with additional modules or circuitry, and that the method of FIG. 6 may be adapted to accommodate different configurations or platforms. For example, the method of FIG. 6 may be adapted to support a cash recycler configured with rollers such as RSMs by modifying the displacement/counting operations associated with step 626 (and step 632).

One or more manual override operations are available in some embodiments that are used to override the results (e.g., the counts, calculations, or signals) generated by the cash recycler. Authorization in the form of a key, password, or the like may be required to override the results generated by the cash recycler. The override operations may be used in some embodiments when a known error or bug exists with respect to a given cash recycler, the override operations may serve as a "patch" until more permanent corrective action can be taken with respect to the cash recycler. As such, the override operations may be used to ensure that a cash recycler can continue to remain in operation for "normal" use by customers/consumers. The override operations may be conducted pursuant to one or more override commands.

The cash recycler may automatically perform an inventory verification to determine the accuracy of the count within the cash recycler upon receiving an indication that one of several possible triggering events has occurred. For instance, upon receiving notification of a jam in the cash recycler the jam may be serviced and the cash recycler will automatically initiate an inventory verification to ensure an accurate count within the cash recycler. The notification of the jam may also be sent to the financial institution, and will then be followed up with a notification of the results of the inventory verification. In this example, the jam may be cleared by a third party maintenance provider or by an employee of the client, retailer, financial institution, etc. For instance, certain individuals may be permitted access to the internal storage areas of the cash recycler in order to clear a jam, such as a supervisor, manager, etc. In some arrangements, only the area containing the jam will be accessible to the individual. For instance, the cash recycler may indicate, via various sensors, that the jam occurred in the bill path containing only $5 bills. Accordingly, the servicer would only be given access to the bill path where the jam occurred, rather than the entire cash recycler where additional denominations are contained. This arrangement is described in additional detail in U.S. patent application Ser. No. 12/183,910, filed Jul. 31, 2008 and entitled, "Selectable Access to Compartments in a Cash Handling Device," which is incorporated herein in its entirety by reference.

The individual may obtain access via a lock, such as a KABA-MAS lock, or by logging into the cash recycler via the user interface. Once the jam is cleared, the cash recycler may automatically initiate the inventory verification to confirm that the physical count of bills corresponds to the logical count of bills and that no theft has occurred. In some arrangements, if a user is logged onto the system when the jam occurs and is still logged on when the jam clears, the inventory verification process may occur immediately on clearing the jam or may be delayed until the user logs off. In some examples when the inventory verification is delayed, the inventory verification will be performed after the user logs off and prior to another user logging on.

In another example, one of several service or maintenance issues may trigger the inventory verification. For instance, completion of scheduled maintenance may trigger an inventory verification, completion of unscheduled maintenance, such as a breakdown or failure of a part, may initiate an inventory verification. In still other arrangements, the automatic inventory verification may occur at regularly schedule, predetermined time intervals (i.e., at night, after business hours, etc.) to provide regularly scheduled audits of the storage area(s) of the cash recycler. In still other arrangements, the automatic inventory verification of the cash recycler may be initiated by a financial institution in communication with the cash recycler.

Figure 7:
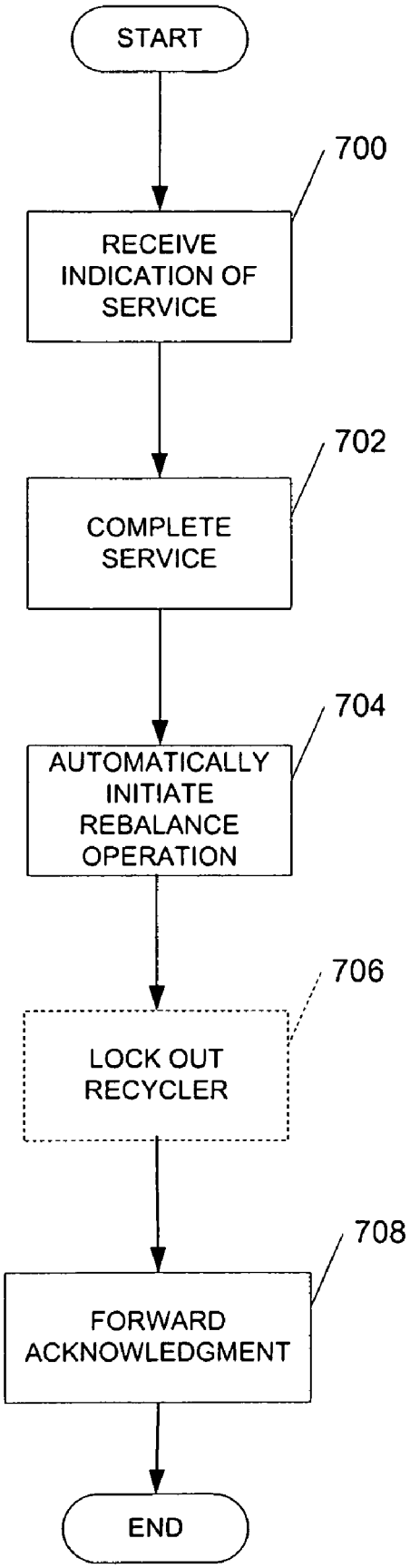
FIG. 7 illustrates a method of automatically rebalancing a cash recycler according to aspects described herein.

FIG. 7 illustrates another method for automatically conducting an inventory verification of a cash recycler according to aspects described herein. The method of FIG. 7 may be used with any suitable cash recycler or currency handling device, such as cash recycler 200 of FIG. 2 which may include features described in FIG. 5. In step 700, a triggering event occurs, such as a jam in the cash recycler, scheduled or unscheduled maintenance, and the like. Upon completion of the service associated with the triggering event in step 702, the cash recycler automatically initiates an inventory verification operation in step 704, similar to the inventory verification or rebalance operation discussed above. For instance, the currency may be removed from a stacker and placed in a cartridge and counted. While the inventory verification operation is ongoing, the cash recycler may "lock out" users in optional step 706. That is, the cash recycler may prevent any transactions from taking place during the inventory verification operation to ensure an accurate count is obtained. This arrangement is described in more detail in U.S. patent application Ser. No. 12/212,446, filed on Sep. 17, 2008 and entitled, "Security to Prevent Transaction Activity Until Audit is Complete" which is incorporated herein in its entirety by reference. Upon completion of the inventory verification operation, a notification or acknowledgement may be sent from the cash recycler to a financial institution in step 708. The notification or acknowledgment may be to a transaction log. Additionally or alternatively, a notification may be an email sent from the cash recycler to the financial institution. In other examples, the notification may be sent to a wireless, handheld device, such as a cell phone, or the notification may be sent to a peripheral device, such as a printer. The acknowledgment may include a cash recycler identification number, as well as an indication that the cash recycler inventory verification was successful or that it was unsuccessful, i.e., the inventory verification operation was not completed for one of many potential reasons. In addition, the acknowledgment may include an indication that the storage portion of the cash recycler was in balance, i.e., had the correct amount of funds, or that it was out of balance, i.e., there was a discrepancy between the amount of funds recorded in transactions and the amount of funds actually held in the cash recycler.

The automatic inventory verification described herein aids in protecting funds from theft. For instance, the automatic inventory verification may be performed after an individual has accessed the storage portion of the cash recycler. The inventory verification will then indicate if any discrepancy exists between the physical count of bills and the logical count of bills, thereby identifying any potential theft. For instance, in some arrangements, certain personnel may have access to the storage portion of the cash recycler in order to fix or remove a jam, for instance. This eliminates the need to arrange for a third party maintenance provider to be used to repair the jam.

Figure 8:
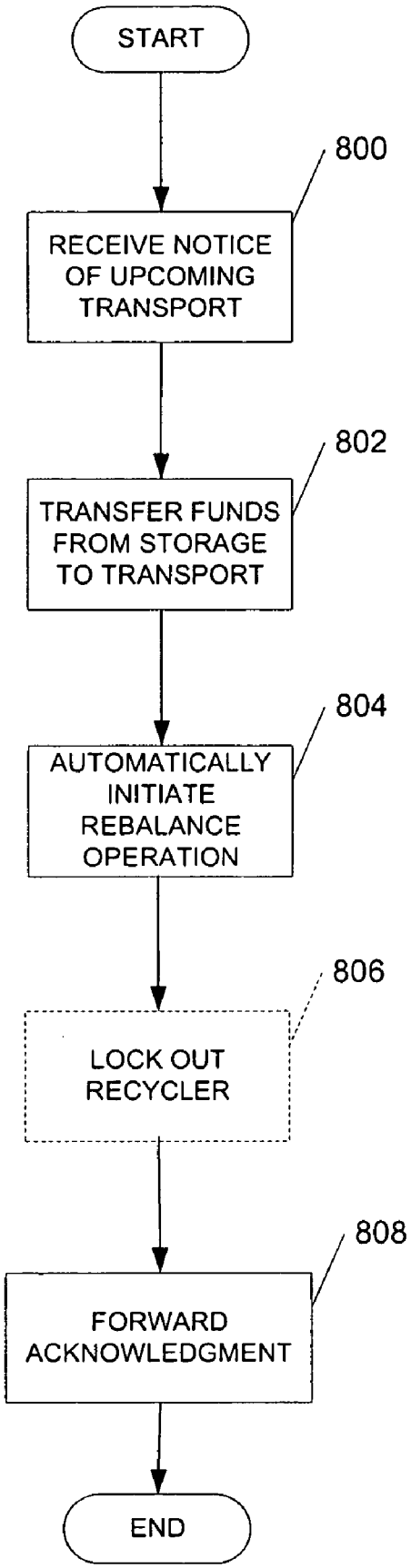
FIG. 8 illustrates another method of automatically rebalancing a cash recycler according to aspects described herein.

FIG. 8 illustrates yet another method for automatically rebalancing a cash recycler according to aspects described herein. In step 800, the cash recycler may receive an indication of an upcoming transport of funds. For instance, funds may be scheduled to be removed from or added to the cash recycler from an outside source, such as a financial institution. The transportation of funds may be performed according to a predetermined schedule or as an on-demand process as removal or addition of funds is needed. In some arrangements, the upcoming transport may initiate an automatic inventory verification of the cash recycler. In some examples, an upcoming transport may initiate a transfer of funds to return the recycling units to a target level (i.e., being replenished by replenishment cartridge or drained to overflow cartridge) prior to the transport. In other arrangements, such as shown in FIG. 8, the cash recycler may receive notification that a transport is upcoming and, in response to the notification, transfer funds from a storage area of the cash recycler, such as a stacker, to a transport area of the cash recycler in order to be transported from the cash recycler, as shown in step 802. The transportation carrier etc. may gain access to the cash recycler via a manual lock on the safe, i.e., a KABA-MAS lock. In these arrangements, the carrier may have access restricted only to certain regions, such as only to cartridges. In some arrangements, a physical wall may be positioned between the recycling units and the cartridges to permit access to the cartridges without allowing access to the recycling units. Once the carrier has removed the funds, a receipt or other notification may be printed or transmitted via email, text messaging, etc. to the client, financial institution, etc. summarizing the activity that occurred during the carrier servicing.

In other arrangements, the carrier may access the cash recycler by logging in through the user interface. The carrier may input a username and password or other identification and verification information (i.e., biometric data, such as an iris scan, fingerprint scan, and the like, unique identification number, RFID badge, etc.) in order to access the storage regions of the cash recycler.

In step 804, an inventory verification operation may be automatically initiated to rebalance the storage area from which the funds were removed for transport. During the inventory verification operation, the cash recycler may be "locked out" from performing transactions, as shown in optional step 806. In step 808, once the inventory verification operation is complete, an acknowledgment may be sent to the cash recycler, financial institution, etc. to indicate the results of the inventory verification operation, similar to the acknowledgment discussed above.

Figure 9:
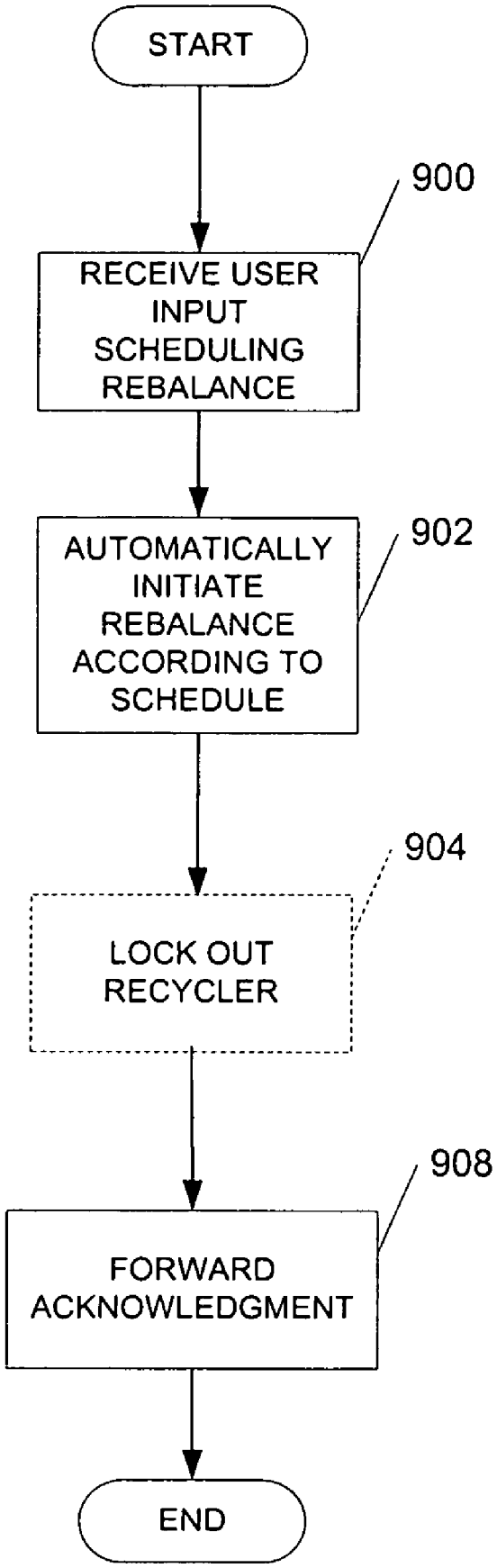
FIG. 9 illustrates still another method of automatically rebalancing a cash recycler according to aspects described herein.

FIG. 9 illustrates still another method of automatically performing an inventory verification of a cash recycler according to aspects described herein. In step 900, the cash recycler may receive user input establishing a schedule for routine automatic rebalancing of the cash recycler. For instance, the cash recycler may be scheduled to automatically perform an inventory verification operation at predetermined times, such as once per day, once per week, etc. In some arrangements, the schedule may be determined at the cash recycler. In other arrangements, the schedule may be determined at a financial institution. When the scheduled time for rebalancing occurs, the cash recycler will automatically initiate an inventory verification of the cash recycler in step 902. During the inventory verification operation, the cash recycler may be "locked out" from performing any transactions, as shown in optional step 904. Upon completion of the inventory verification operation, an acknowledgment will be forwarded in step 906 indicating the outcome of the inventory verification operation, similar to the acknowledgment discussed above.

In still other arrangements, a financial institution may initiate an automatic inventory verification of any cash recycler with which it is in communication. For instance, a financial institution may, as desired, transmit a signal to a cash recycler, via a network, to initiate an automatic inventory verification operation. During the automatic inventory verification process, the cash recycler may be locked out, as described above. Once the automatic inventory verification operation is complete, an acknowledgement of the automatic inventory verification may be transmitted to the financial institution.

Figure 10:
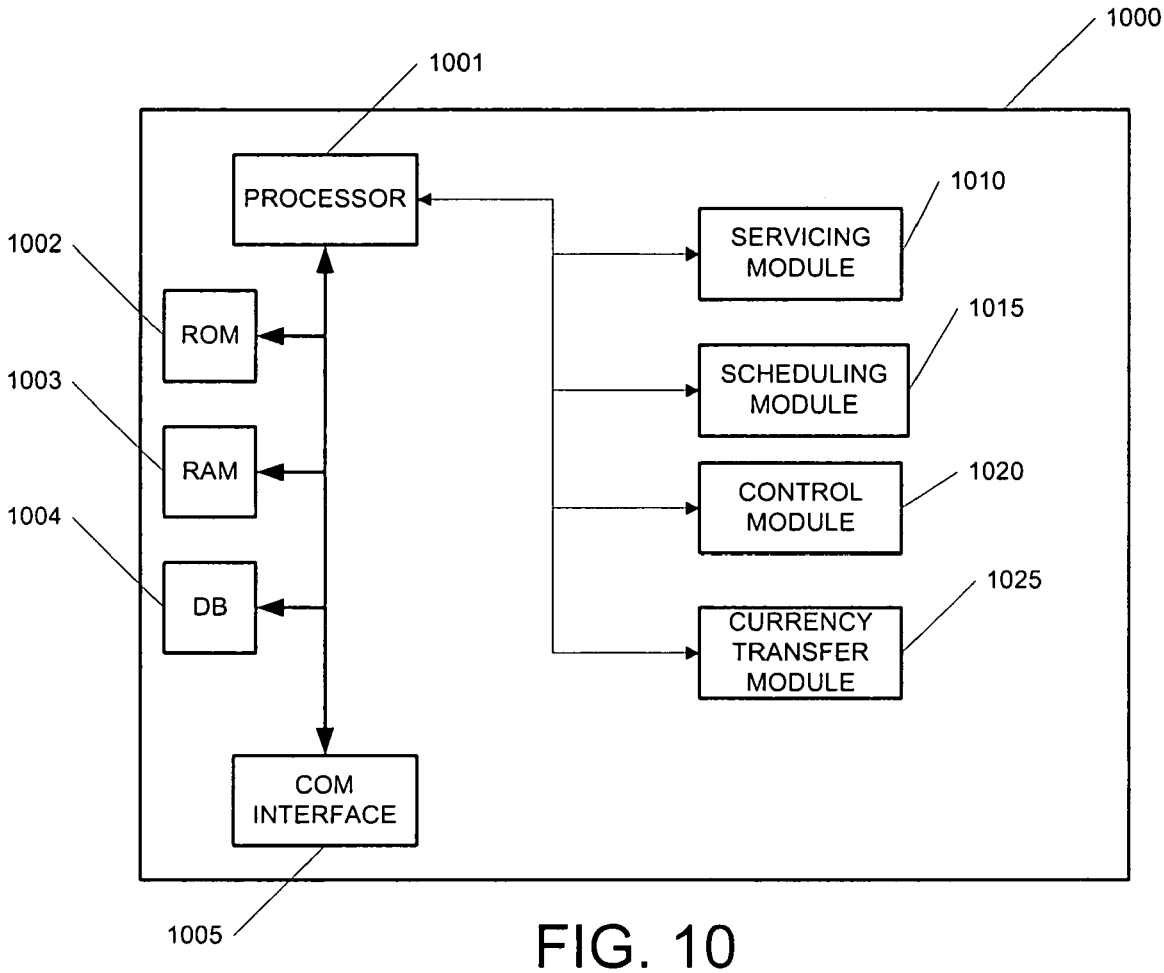
FIG. 10 is a schematic diagram of an example cash recycler including various modules for automatically rebalancing a cash recycler according to aspects described herein.

FIG. 10 illustrates an apparatus having various modules for automatically rebalancing a cash recycler according to one or more aspects described herein. Apparatus 1000 may include a processor 1001, memory such as ROM 1002, RAM 1003, database 1004, and a communication interface 1005, a servicing module 1010, a scheduling module 1015, a control module 1020, and a currency transfer module 1025. Processor 1001 may be configured to execute various instructions and perform calculations based on data received from modules 1010, 1015, 1020, and 1025. Servicing module 1010 may be configured to determine when a service issue has occurred and send an error message or warning indicating there is a service issue. For instance, if a jam should occur in the machine, the service module 1010 may send a warning to the user interface of the cash recycler 1000 indicating the location of the jam. In addition, the servicing module may provide indications of when regularly scheduled maintenance should occur. Scheduling module 1015 may be configured to receive user input regarding regularly scheduled automatic inventory verification operations and may control the initiation of the automatic inventory verification according to the schedule. Control module 1020 may be configured to prevent transactions from occurring at the cash recycler during an automatic inventory verification operation. The currency transfer module 1025 may be configured to transfer funds from a storage region of the cash recycler to a transport region of the cash recycler upon receiving an indication of an upcoming transport of funds. An inventory verification operation may be automatically initiated upon completion of the transfer of funds.

In some arrangements, the control system may be configured to advance a scheduled time for a transfer of funds between a recycling unit and a cartridge. For instance, if an inventory verification process is to occur, i.e., is scheduled, maintenance is going to be completed, etc., and it is within a predetermined number of hours of a scheduled transfer of bills from one or more recycling units to an overflow cartridge, the system may advance the scheduled transfer to move the currency prior to conducting the inventory verification process. This arrangement will reduce the number of notes being moved within the cash recycler. Additionally or alternatively, if it is noted that one or more cash recyclers are above a target level prior to an inventory verification, the recycling units may have currency transferred out of the unit to a cartridge prior to the inventory verification to reduce any inventory verification issues associated with expansion of the bills, etc. In some arrangements, springs or other volume control units may be used to reduce expansion associated with handling the bills.

One of skill in the art will appreciate that the operations, calculations, and computations described herein may take place based on units of counts or amounts in terms of currency/cash. For example, one of skill in the art will appreciate that if a cash recycler has a count of U five dollar bills, the cash recycler has $(U×5) in terms of cash value. More generally, the amount of cash is the product of the number of bills of a given denomination multiplied by the value per bill. Accordingly, the terms "count" and "amount" are used throughout this disclosure interchangeably, recognizing that the two terms are synonymous and simply different ways to express the same quantity.

Although not required, one of ordinary skill in the art will appreciate that various aspects described herein may be embodied as a method, a data processing system, or as a computer-readable medium storing computer-executable instructions. Accordingly, those aspects may take the form of an entirely hardware embodiment, an entirely software embodiment or an embodiment combining software and hardware aspects. The functionality may be resident in a single computing device, or may be distributed across multiple computing devices/platforms, the multiple computing devices/platforms optionally being connected to one another via one or more computing networks. In addition, various signals representing data or events as described herein may be transferred between a source and a destination in the form of electromagnetic waves traveling through signal-conducting media such as metal wires, optical fibers, and/or wireless transmission media (e.g., air and/or space).

Aspects of the invention have been described in terms of illustrative embodiments thereof Numerous other embodiments, modifications and variations within the scope and spirit of the appended claims will occur to persons of ordinary skill in the art from a review of this disclosure. For example, one of ordinary skill in the art will appreciate that the steps illustrated in the illustrative figures may be performed in other than the recited order, and that one or more steps illustrated may be optional in accordance with aspects of the disclosure.

What is claimed is:

1. A method comprising:

determining by a processor in a cash recycler that a malfunction has occurred in the cash recycler;

upon determining that the malfunction has been corrected, said processor automatically conducting an inventory verification operation of currency in a storage portion of the cash recycler including:

automatically displacing currency from at least one stacker to at least one cartridge; and counting the currency displaced from the at least one stacker.

2. The method of claim 1, wherein the malfunction is one of a jam in the cash recycler and an unscheduled maintenance of the cash recycler.

3. The method of claim 1, further including during the step of automatically conducting an inventory verification operation of the currency in the storage portion of the cash recycler, preventing a user from performing a transaction at the cash recycler.

4. The method of claim 1, further including transmitting an acknowledgment of the automatic inventory verification.

5. The method of claim 4, wherein the acknowledgment includes an identification of the cash recycler and an indication of the successful completion of the automatic inventory verification.

6. The method of claim 4, wherein the acknowledgment includes at least an indication of the balance of the cash recycler being correct.

7. One or more computer-readable media storing computer-executable instructions stored that when executed, cause an apparatus to perform a method comprising:

determining by a processor in a cash recycler that a malfunction has occurred in a cash recycler;

upon determining that the malfunction has been corrected, said processor automatically conducting an inventory verification of the currency in a storage portion of the cash recycler including:

automatically displacing currency from at least one stacker to at least one cartridge; and counting the currency displaced from the at least one stacker.

8. The one or more computer-readable media of claim 7, wherein the malfunction is one of a jam in the cash recycler and an unscheduled maintenance of the cash recycler.

9. The one or more computer-readable media of claim 7, further including during the step of automatically conducting the inventory verification of the currency in the storage portion of the cash recycler, preventing a user from performing a transaction at the cash recycler.

10. The one or more computer-readable media of claim 7, further including transmitting an acknowledgment of the automatic inventory verification.

11. An apparatus, comprising:

at least one processor; and memory operatively coupled to the at least one processor and storing computer readable instructions that, when executed, cause the apparatus to perform a method comprising:

determining by the at least one processor that a malfunction has occurred in a cash recycler;

upon determining that the malfunction has been corrected, said at least one processor automatically conducting an inventory verification of the currency in a storage portion of the cash recycler, wherein automatically conducting an inventory verification of the currency in the storage portion of the cash recycler includes:

automatically displacing currency from at least one stacker to at least one cartridge; and counting the currency displaced from the at least one stacker.

12. The apparatus of claim 11, wherein the malfunction is one of a jam in the cash recycler and an unscheduled maintenance of the cash recycler.

13. The apparatus of claim 11, further including during the step of automatically conducting an inventory verification of the currency in the storage portion of the cash recycler, preventing a user from performing a transaction at the cash recycler.

14. The apparatus of claim 11, further including transmitting an acknowledgment of the automatic inventory verification.

15. A method, comprising:

receiving, by a processor of a cash recycler, an indication of an upcoming transport of funds;

upon receiving the indication of the upcoming transfer of funds, transferring funds from a storage region to a transport region; and upon completion of the transfer of funds, said processor automatically conducting an inventory verification of the storage region of the cash recycler, wherein automatic inventory verification of the storage region includes:

automatically displacing currency from at least one stacker to at least one cartridge; and counting the currency displaced from the at least one stacker.

16. The method of claim 15, further including during the step of automatically conducting an inventory verification of the currency in the storage portion of the cash recycler, preventing a user from performing a transaction at the cash recycler.

17. The method of claim 15, further including transmitting an acknowledgment of the automatic inventory verification.

18. The method of claim 17, wherein the acknowledgment is transmitted to a financial institution.

19. The method of claim 18, wherein the acknowledgment is transmitted via email.

20. The method of claim 17, wherein the acknowledgment is transmitted to a printer.

* * * * *